US005779295A

United States Patent [19]

Auston

[11] Patent Number: 5,779,295

[45] Date of Patent: Jul. 14, 1998

[54] LIFTING PLATE FOR SLINGS

[75] Inventor: Paul Auston, Kent, England

[73] Assignee: Checkmate UK Limited, United Kingdom

[21] Appl. No.: 764,714

[22] Filed: Dec. 10, 1996

[30] Foreign Application Priority Data

Aug. 6, 1996 [GB] United Kingdom ..... 9612012.06

[51] Int. Cl.[6] ..... B65H 49/00; B66C 1/16

[52] U.S. Cl. ..... 294/67.1; 294/1.1

[58] Field of Search ..... 294/1.1, 67.1, 294/67.3, 67.4, 74, 75, 81.55, 82.1, 82.11, 89, 93, 97, 158; 414/911

[56] References Cited

U.S. PATENT DOCUMENTS

| | | | |
|---|---|---|---|
| 259,214 | 6/1882 | Roberts | 294/67.1 |
| 1,525,090 | 2/1925 | Rutan | 294/82.1 X |
| 1,735,713 | 11/1929 | Alltop | 294/97 |
| 2,955,855 | 10/1960 | Jobbins | 294/74 X |
| 3,583,753 | 6/1971 | McCrory | 294/97 X |
| 4,525,007 | 6/1985 | Chapalain | 294/74 |
| 4,796,939 | 1/1989 | Symonds et al. | 294/67.1 |
| 4,946,212 | 8/1990 | Pruitt | 294/67.1 |

*Primary Examiner*—Johnny D. Cherry
*Attorney, Agent, or Firm*—Charles D. Gunter, Jr.

[57] ABSTRACT

The present invention relates to a base plate assembly for use in lifting articles having a bore therethrough. The base plate assembly is formed having a base adapted to receive and support the article with its bore extending substantially normally from the base. An annular wall member upstands from the base plate and is adapted to locate in the bore. A load-bearing cross member extends substantially diametrically across the interior of the wall member and is provided with a securing device so that the cross member is positively secured to the wall member. The securing device is disengageable so that the cross member can be demounted from the wall member. A length of load-bearing sling material has one end adapted to be passed up the bore in the article to extend beyond the distal end of the bore and to provide a loop by which the base plate and the associated article can be lifted. The other end of the length of sling material is formed as a loop around the cross member for attaching to the base plate.

10 Claims, 1 Drawing Sheet

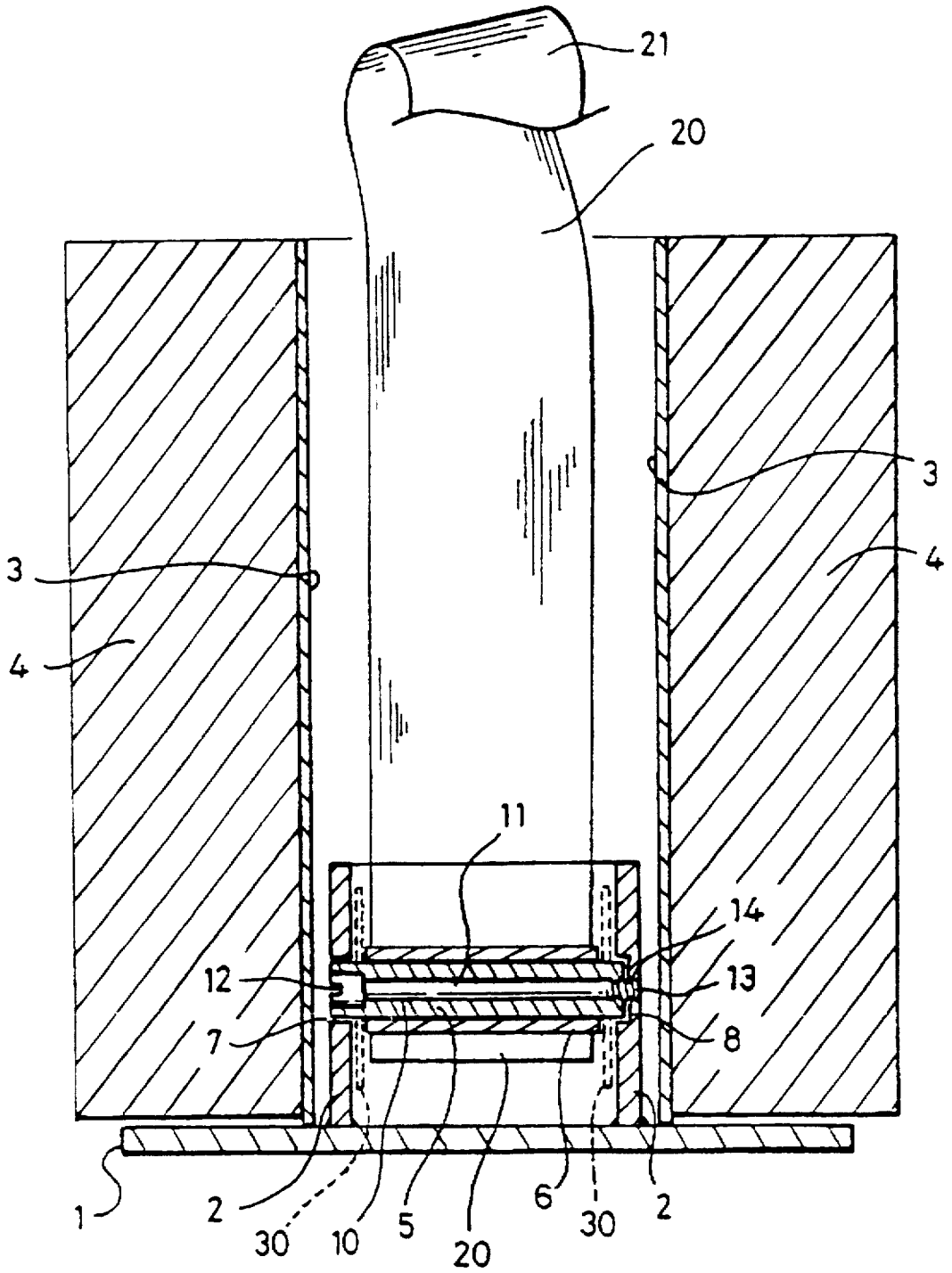
21
20
3
3
4
4
11
14
12
13
7
8
1
2
30
10
5
20
6
30
2

LIFTING PLATE FOR SLINGS

The present invention relates to a device, notably to a base plate assembly for load lifting slings.

BACKGROUND TO THE INVENTION

Many forms of load bearing slings are used to handle cargo, notably ship-carried cargoes. One such cargo is newsprint paper which is shipped in large rolls wound upon a hollow tubular core. To lift such rolls, a lifting sling is passed through the tubular core and the free ends of the sling lifted by a hook or the like. It has been proposed in U.S. Pat. No. 4,946,212 to form the lifting sling with a base plate to which one end of a continuous loop of sling material is secured by being passed through a chain link or other heavy duty ring of metal welded to the base plate. The other, free, end of the loop of sling material is passed up the tubular core of the newsprint roll and extends beyond the upper face of the roll to provide a lifting loop with which the lifting hook of a crane or a tine of a fork lift truck can be engaged. It is preferred to provide an upstanding skirt around the ring which engages in the foot of the tubular core to align and locate the roll upon the base plate.

Such a lifting sling suffers from the disadvantage that it has been considered necessary to manufacture it from heavy duty and comparatively massive components for safety and load-bearing reasons. Furthermore, because the lower end of the loop of sling material is retained by a closed ring of metal, the whole lifting sling must be returned to the manufacturer for service and repair if the sling material becomes frayed or otherwise damaged. This represents an added cost and inconvenience to the user.

Surprisingly, we have now found that the ring of metal attached to the base plate need not be as massive as hitherto considered necessary and that it can be formed with a removable section to permit separation of the sling loop from the base plate for service and repair. Furthermore, the removable section can be attached to the upstanding skirt of material which is used to locate the tubular core of the roll of paper on the base plate, thus avoiding the need to provide the side and base members of the metal ring required in U.S. Pat. No. 4,946,212 and simplifying the construction of the base plate.

It has been proposed in U.S. Pat. No. 4,796,939 to provide an annular upstand on a lifting plate with a removable transverse wedge located in the basal loop of the lifting sling. The wedge traps the basal loop of a lifting sling against co-operating faces in the underside of the base plate when tension is applied to the loop during lifting of a load carried by the base plate. However, such a mechanism can cause excessive chafing of the material of the lifting loop at the opposing faces of the wedge and the base plate or the edges of the wedge can cut the loop fabric leading to premature failure of the lifting loop. Furthermore, when the tension on the lifting loop is released when the load is lowered to the ground, the wedge can drop out of engagement with the co-operating faces of the underside of the base plate. When tension is re-applied, the wedge may not seat correctly and can then cut through the fabric of the loop material as the lifting force is applied, resulting in failure of the loop, which may occur when the load is suspended above ground level. Alternatively, the wedge may drop out of the loop of material so that the loop is not restrained but passes through the bore of the tube when tension is applied to the lifting loop.

SUMMARY OF THE INVENTION

Accordingly, the present invention provides a base plate assembly for use in the lifting of articles having a bore therethrough, which base plate assembly comprises:

a. a base plate adapted to receive and support the article with its bore extending substantially normally from the base plate;

b. an annular wall member upstanding from the base plate and adapted to locate in the said bore;

c. a load-bearing cross member extending substantially diametrically across the interior of the wall member at or adjacent the open end of the wall member and provided with securing means whereby the cross member is positively secured to the wall member, said securing means being disengageable by a positive action by the operator of the assembly whereby the cross member can be demounted from the wall member; and d. a length of load-bearing sling material, one end of which is adapted to be passed up said bore in the article to extend beyond the distal end of the bore and to provide a loop by which the base plate and the associated article can be lifted, the other end of said length of material being formed as a loop around said cross member whereby said length of material is attached to said base plate.

Preferably, the base plate assembly is substantially symmetrical about the axis of the intended direction of lifting so that the assembly applies a substantially symmetrical lifting force to the article passing through the centre of gravity of the article.

The base plate can take any suitable form, for example a square or circular metal plate. The plan dimensions and thickness of the base plate are selected to suit the load which it is to bear. Typically, a roll of newsprint weighs about 1 tonne and the plate will be from 15 to 30 cms plan diameter and about 2 to 5 mms thick mild steel. For other loads, the plate dimensions may be different and the optimum shape and size can readily be determined by simple trial and error. The plate will usually be painted or plastic coated to protect it from rain and chemical corrosion.

The base plate carries an upstanding annular wall. The wall serves to locate the base plate so that it aligns with the bore in the article, for example the central tube core to a roll of newsprint. Whilst it will usually be preferred that the wall has a circular plan shape, this need not be the case and other plan shapes, eg. oval, square or triangular, may be used. The wall may be circumferentially continuous or may be formed as a series of segments. For convenience, the invention will be described hereinafter in terms of a continuous annular wall around the centre point of a circular base plate.

The wall may be a simple ring of metal welded or otherwise secured by its circumferential base to the base plate. However, we have surprisingly found that the wall can be of smaller thickness than the massive metal chain link rings used hitherto to connect the lifting loop to the base plate. The annular wall is thus typically from 2 to 12.5, preferably 5 to 10, mms thick. The wall forms an annular upstand from the face of the base plate which typically extends from 2 to 5 cms from the base plate. If desired, the external face of the wall can be inclined to present a tapered face to the base of the bore in the article into which it is to engage to assist entry of the wall annulus into the bore. Apart from serving to locate and align the base plate with the bore of the article, the annular wall also serves to provide the mounting for the removable cross member to which the lifting loop of the length of sling material is connected. Surprisingly, we have found that even where the cross member is located closely adjacent the axially upper end of the wall, sufficient wall material remains to support the weight of many loads. Typically, the cross member is located with its upper edge from 1 to 5 mms from the top of the annular wall. It is also preferred to provide a clearance of from 2 to 10 mms between the bottom surface of the cross member and the upper face of the base plate to permit the insertion and relative movement of the sling material upon the cross member's lower surface.

The cross member conveniently takes the form of a simple cylindrical cross bar. However, the bar may carry a rotating sleeve thereon to assist positioning of the loop at the bottom of the length of sling material upon the cross member. Alternatively, the surface of the cross bar can be polished or given a low friction coating to aid relative movement of the sling material with respect to the cross member. The cross member can be made from any material having an adequate tensile strength for the loads to be lifted, for example high tensile, stainless or tool steel, and is typically of from 5 to 15 mms diameter.

The cross member is removably attached to the annular wall by a securing means so that it can be removed upon disengagement of the securing means to enable the sling material to be replaced or repaired. Thus, the cross member preferably extends through the annular wall at substantially diametrically opposed positions in the annulus and is secured in position by any suitable mechanism, for example by circlips or locking collars or by radial bolts extending through the wall and axially into the cross member, which positively secure the cross member in position, but which can be disengaged by a positive action by the user of the assembly to permit the cross member to be demounted from the annular wall. Preferably, the wall of the annulus is cut with an aperture through which the cross member is a close sliding fit and extends diametrically across the annulus to a socket or recess in the interior of the opposed wall of the annulus. The socket or recess provides a seat into which the distal end of the cross member locates. A screw threaded pin passes through the remainder of the thickness of the wall of the annulus into a screw threaded bore in the distal end of the cross member to secure the cross member positively in position. Alternatively, the cross member is mounted upon a substantially co-axial pin which has a screw threaded distal end which engages a co-operating screw threaded bore in the base of the recess into which the distal end of the cross member engages. Such a construction reduces the radial projection of the cross member and its securing mechanism beyond the external wall of the annulus, thus reducing the risk of snagging in the tubular bore of the article being lifted.

Alternatively, the cross member can have a circumferential groove adjacent each end thereof which engages with the radially inward rim of the apertures in the annular wall. Preferably, the transverse cross section of the cross member and the shape of the apertures are radially asymmetric so that in one relative orientation of the cross member to the apertures in the annular wall, the cross member can pass through the aperture until the grooves therein are in register with the rims of the apertures. Rotation of the cross member brings the grooves and rims into positive engagement with one another positively locking the cross member in position. It may be desired to provide a secondary locking mechanism, for example a transversely acting screw, to retain the relative orientation of the cross member and the aperture rims in the engaged position and thus minimise the risk of accidental rotation of the cross member.

For convenience, the invention will be described hereinafter in terms of a cross bar which has a securing means comprising a co-axial pin with a distal screw threaded end thereto which engages a co-operating screw threaded bore in the annular wall, the exposed proximal end of the screw being recessed into the proximal end of the cross member and provided with a screw slot or Allen key recess to enable the screw to be rotated when the cross member is in position to lock the member in position. The distal end of the pin has an enlarged radial diameter so that it traps the cross member in position when the distal end of the pin is screwed home. In such an assembly, the cross member is positively secured in position and does not release the lifting loop when tension is applied to or released from the loop so that chafing of the loop material or cutting of the loop material is minimised. However, the cross member can readily be demounted so as to released the loop for replacement or repair.

The base plate assembly is provided with a removable sling by which the assembly is lifted. The sling is in the form of a loop of sling material whose distal end is to be engaged by a hook or the like to lift the assembly. The proximal end is formed as a loop through which the cross member passes so as to attach the base plate to the sling. The sling material can be formed as a single continuous loop of material or can be formed as two loop ends connected by a length sling material. For convenience, the invention will be described hereinafter in terms of a single loop of material. The sling material can be of any suitable type, for example a braided rope or a flat webbing strap, and can be made from any suitable natural or synthetic material. It is particularly preferred to use the conventional woven polyester webbing as used in the manufacture of load bearing slings.

As stated above, the bottom end of the loop of sling material passes around the cross member to attach the base plate to the loop. The other end of the loop is to be passed through the bore in the article to extend beyond the end of the bore to provide a top loop by which the base plate and its associated article can be lifted. The top loop can be of any suitable size having regard to the lifting hook or other mechanism which is to engage the top loop for lifting the article. Typically, the top loop will upstand from 10 to 30 cms above the top surface of the article. The total length of the loop of sling material will thus vary according to the size of the article on which it is to be used and the optimum length can readily be determined by simple trial and error tests.

The base plate assembly of the invention can be used with a wide range of articles having a bore therein through which the sling loop can be passed. However, the base assembly is of especial application for articles in which the centre of gravity lies substantially upon the longitudinal axis of the bore which passes through the article so that they adopt a stable position when lifted with the bore in the substantially vertical position. Preferably, the articles are generally symmetrical about the longitudinal axis of the bore through the article. Thus, the invention is of especial application in the lifting of rolls of material, for example newsprint or rolls of steel strip, or tubular items, for example metal pipes or the like.

During use, the sling material may become frayed or over stretched when the safe load limit of the sling material is exceeded. The cross member can readily be demounted from the annular wall by disengaging the securing means and thus permit the sling material to be separated from the base plate for repair or replacement. With the prior art designs of base plate, the loop of sling material had to be cut away from the base plate, thus requiring total replacement of the loop of sling material; there was a risk of premature failure of the loop. For safety reasons, replacement of the lifting loop had usually to be done by the original manufacturer of the lifting sling/base plate combination, requiring return of the combination by the user to the manufacturer. With the assembly of the invention, the user can replace a worn or damaged loop of sling material without the need to return the assembly to the manufacturer. Furthermore, since the cross member is mounted within the height of the annular wall and comparatively close to the upper edge of the wall, the base plate assembly of the invention can be made more compact than prior art designs, with attendant saving in materials and costs. Since the securing means acts positively to secure the cross member in position, the risk of accidental or premature disengagement of the cross member is eliminated, thus rendering the base plate of the invention safer in use. Furthermore, since nipping of the loop material or chafing-on sharp corners of an unsecured wedge type cross member is avoided, premature failure of the loop material is reduced.

DESCRIPTION OF THE DRAWINGS

To aid understanding of the invention, a preferred form thereof will be described by way of illustration with respect to the accompanying drawing which is a vertical sectional view of the base plate assembly in position to lift a roll of newsprint.

DESCRIPTION OF THE PREFERRED EMBODIMENT

The assembly comprises a steel base plate 1, which is preferably of a circular or square plan shape having a diameter or side dimension of about 15 cms and a thickness of about 3.5 mms. Extending upwardly from the upper face of plate 1 is an annular steel wall 2 welded to the plate along its basal circumference. The wall 2 can be continuous as shown or can be formed as separate segments. The wall has an external diameter which is slightly less, say from 1 to 5 cms less, than the internal diameter of the tubular core 3 upon which the roll of newsprint 4 is wound. The wall 2 typically has a radial thickness of about 5 mms and extends upwardly for about 5 cms from the upper face of plate 1.

Extending across the interior of the annulus of wall 2 is a cross member 5. This can be a solid cylindrical bar of steel or the like having an external diameter of about 10 mms and can carry a sleeve 6 thereof which can rotate about the common longitudinal axis of the bar 5 and sleeve 6. Alternatively, the bar can have a polished surface or can have a PTFE or other low friction surface to allow the sling material to move freely upon the surface of bar 5.

Bar 5 extends as a sliding or clearance fit through an aperture 7 in one side wall of the annulus of wall 2 diametrically to a recess 8 in the interior surface of the wall at the opposed side of the annulus. The aperture and the recess are formed so as to leave about 3 to 5 mms of wall axially beyond the aperture or recess. Within bar 5 there is an axial bore 10 within which is journalled a pin 11 which is a close or sliding fit within the bore 10. The proximal end of pin 11 is provided with a screw driver cross slot or a hexagonal or other Allen key receiving recess 12 by which the pin can be rotated about its longitudinal axis, which need not be coincident with the longitudinal axis of the bar 5 so as to minimise the risk of pin 11 being unscrewed as load is applied to bar 5. The other end of the pin 11 carries a screw thread 13 which engages with a screw threaded recess 14 in the radially outward face of recess 8 so that pin 11 can be secured in place. Pin 11 has an enlarged proximal head so that it in turn secures bar 5 in position and pin 11 thus acts as a disengageable securing means for securing the bar 5 in position. Alternatively, bar 5 can carry the screw threaded extension to engage recess 8 and bore 10 and pin 11 can be omitted. The bar 5 and pin 11 when present are dimensioned so that the exposed proximal end face of bar 5 and pin 11 are substantially flush with the exterior face of wall 2.

A loop of polyester webbing sling material 20 passes around bar 5 and upwardly through the tubular core 3 of the roll 4 of newsprint to provide a lifting loop 21 upstanding above the top face of the roll 4. The roll and the plate 1 can be lifted by loop 21 in the usual manner.

However, if the sling material is damaged or worn, it can be removed from plate 1 by undoing the screw engagement of pin 11 or bar 5 with the recess 8 in wall 2 to allow bar 5 to be removed radially through aperture 7. The end bight of a new or repaired loop 20 can then be inserted into the space within the annulus of wall 2 and bar 5 inserted through the loop of material to attach loop 20 to plate 1 and bar 5 locked in position by engaging the screw threads of pin 11 or the distal end of bar 5 into the recess 8.

Due to the clearance between the bottom face of bar 5 and the upper face of plate 1, which is typically at least about 5 to 10 mms, the material of loop 20 can slide freely over the surface of bar 5 to adopt a position at which the remainder of the loop is symmetrical and thus carries the load of the roll 4 evenly throughout its length.

As indicated above, other means for locking bar 5 in position spanning the interior of the annulus of wall 2 can be devised. For example, recess 8 can be an aperture through the wall thickness similar to aperture 7 and bar 5 is held in position by removable circlips 30 at each end thereof as shown dotted in FIG. 1. The circlips can be located externally of wall 2, but are preferably located within the annulus of wall 2 as shown to reduce the risk of snagging during the engagement of wall 2 within the foot of the bore 3 in the roll 4.

The invention has been described above in terms of the lifting of a single article upon plate 1. However, it will be appreciated that the loop 20 can pass through the bores in a number of articles in a stack and the stack lifted as a unit.

I claim:

1. A base plate assembly for use in the lifting of articles having an axial bore therethrough extending from a base of the article to an upper end of the article, which bore has a proximal end at the base of the article and a distal end at the upper end of the article, the base plate assembly comprises:

a. a base plate for receiving and supporting the article, with the axial bore of the article extending substantially normally from the base plate; and b. an annular wall member upstanding from the base plate and extending axially from a proximal end at the base plate to an open distal end, the annular wall member axially engaging the axial bore of the article, with the article locating upon the base plate, the annular wall member having a radially inward face which encompasses an internal space within the annular wall member and having diametrically opposed recesses or apertures in the radially inward face of the upstanding annular wall adjacent the open end of the annular wall member; and c. a load-bearing cross member comprising a metal bar which extends substantially diametrically across the internal space within the annular wall member adjacent the open end of the wall member, the cross member having end portions which are located in said diametrically opposed recesses or apertures in the annular wall member; and d. securing means operatively associated with at least one of said end portions of said cross member, which securing means acts to positively secure said end portions in position in said recesses or apertures in the annular wall member, said securing means being disengageable whereby the cross member can be demounted from the annular wall member; and e. a length of load-bearing sling material having a loop formed at each end thereof, one end of which length of sling material being passed up said bore in the article and extending beyond the upper end of the article so as to provide a first loop by which the base plate and an article located on the base plate can be lifted, the second loop at the other end of said length of sling material being located around said cross member whereby said length of sling material is attached to said base plate.

2. A base plate assembly as claimed in claim 1, wherein the base plate is substantially symmetrical about the axis of the annular wall member so that the assembly applies a substantially symmetrical lifting force to an article located on said base plate.

3. A base plate assembly as claimed in claim 1, wherein the length of sling material is formed as a single loop of material having a first and second end, the first and second ends providing said first and second loops respectively.

4. A base plate assembly as claimed in claim 1, wherein the annular wall member is provided by a generally circular ring metal member welded to a metal base plate.

5. A base plate assembly as claimed in claim 4, wherein the securing means comprises a pin passing axially through the cross member and engaging a screw threaded recess in the annular wall member.

6. A base plate assembly as claimed in claim 1, wherein the securing means comprises a screw threaded member engaging a corresponding screw threaded recess in the annular wall member.

7. A base plate assembly for use in the lifting of articles having an axial tubular core passing axially therethrough and extending from a base of the article to an upper end of the article, which core has an axial bore which has a proximal end at the base of the article and a distal end at the upper end of the article, the base plate assembly comprises:

a. a metal base plate for receiving and supporting the article with the axial tubular core of the article extending substantially normally from the base plate; and b. a metal annular wall member welded to and axially upstanding from the base plate, the annular wall member engaging the axial bore of the tubular core of the article so that the article locates upon the base plate, the annular wall member extending axially from a proximal end at the base plate to an open distal end, the annular wall member axially engaging the bore of the article with the article locating upon the base plate, the annular wall member having a radially inward face which encompasses an internal space within the annular wall member and having diametrically opposed recesses or apertures in the radially inward face of the upstanding annular wall adjacent the open end of the annular wall member; and c. a load-bearing cross member comprising a metal bar which extends substantially diametrically across the internal space within the annular wall member adjacent the open end of the wall member, the cross member having end portions which are located in said diametrically opposed recesses or apertures in the annular wall member; and d. securing means operatively associated with at least one of said end portions of said cross member which securing means acts to positively secure said end portions in position in said recesses or apertures in the annular wall member, said securing means comprising screw threaded inter-engaging members carried by the cross member and the recess or aperture in the radially inward face of the annular wall member, which inter-engaging screw threaded members are disengageable from one another whereby the cross member can be demounted from the annular wall member; and e. a length of load-bearing sling material having a loop formed at each end thereof, one end of which length being passed axially up said bore in the article and extending axially beyond the upper end of the article so as to provide a first loop by which the base plate and an article located on said base plate can be lifted, the second loop at the other end of said length of sling material being located around said cross member whereby said length of sling material is attached to said base plate.

8. A base plate assembly as claimed in claim 7, wherein the securing means comprises a pin passing axially through an axial bore in the cross member and having a distal end carrying a screw thread which is adapted to engage a screw threaded recess in the annular wall member.

9. A base plate assembly as claimed in claim 8, characterised in that the length of sling material is formed as a single loop of material having a first and second end, the first and second ends providing said first and second loops respectively.

10. A base plate assembly as claimed in claim 7, characterised in that the length of sling material is formed as a single loop of material having a first and second end, the first and second ends providing said first and second loops respectively.

* * * * *

UNITED STATES PATENT AND TRADEMARK OFFICE
CERTIFICATE OF CORRECTION

PATENT NO. : 5,779,295

DATED : July 14, 1998

INVENTOR(S) : Paul Auston

It is certified that error appears in the above-identified patent and that said Letters Patent is hereby corrected as shown below:

On the Title page, item [56] Reference Cited:
Under Foreign Application Priority Data, please delete "Aug. 6, 1996" and insert --June 8, 1996--.

Signed and Sealed this

Twenty-third Day of February, 1999

*Attest:*

Q. TODD DICKINSON

*Attesting Officer*

*Acting Commissioner of Patents and Trademarks*